United States Patent [19]

Trincia

[11] 4,434,828

[45] Mar. 6, 1984

[54] SCREWDRIVER WITH HANDLE FOR STORING BITS

[76] Inventor: Richard Trincia, 149 Dunsinane Rd., New Castle, Del. 19720

[21] Appl. No.: 450,985

[22] Filed: Dec. 20, 1982

[51] Int. Cl.[3] ..... B25G 1/08

[52] U.S. Cl. ..... 145/62

[58] Field of Search ..... 145/62, 63

[56] References Cited

U.S. PATENT DOCUMENTS

| | | | |
|---|---|---|---|
| 733,126 | 7/1903 | Bellows | 145/62 |
| 1,712,343 | 5/1929 | Gerhardt | 145/62 |
| 4,253,356 | 3/1981 | Martinmaas | 145/62 |
| 4,268,927 | 5/1981 | Bridwell | 145/62 |

FOREIGN PATENT DOCUMENTS

| | | | |
|---|---|---|---|
| 392650 | 3/1924 | Fed. Rep. of Germany | 145/62 |

*Primary Examiner*—Frederick R. Schmidt
*Assistant Examiner*—J. T. Zatarga
*Attorney, Agent, or Firm*—Mortenson & Uebler

[57] ABSTRACT

A screwdriver is provided having a handle for storing bits. The stored bits are held in the handle in transverse orientation with respect to the long axis of the screwdriver by sleeves of resiliant material which are press fit into transverse openings through the handle. The sleeves have internal diameters slightly smaller than the outside diameters of the bits being stored. To remove one of the stored bits for use, the user simply removes the bit previously used and which is magnetically held to the screwdriver shaft and presses it into the opening in the sleeve holding the desired bit, thereby freeing the desired bit and, at the same time, storing the bit previously used. The desired bit is then affixed to the magnetic holding means.

5 Claims, 5 Drawing Figures

2
3
4
5
6
8A
8B
8C
8D
10
12
14

SCREWDRIVER WITH HANDLE FOR STORING BITS

BACKGROUND OF THE INVENTION

This invention relates to screwdrivers and particularly to screwdrivers having multiple bits and a handle for storing the bits.

Screws are available to cabinet makers, mechanics and others in a number of different configurations to suit different uses. The most common of these are the slotted head having a single diametric slot, a "Phillips" head having a cross-shaped recess and a "Robertson" head having a square recess.

Because of these different types of screws there is a need for a screwdriver which provides a choice of blades and which has storage means for the multiple blades to prevent their loss.

Multiple bit screwdrivers having various bit-storing means are known in the prior art. U.S. Pat. No. 4,327,790 (Stevens et al, 1982) discloses a screwdriver comprising a handle having four screwdriver blades pivotally connected adjacent one end. The blades may be pivoted from a stored position alongside the handle to an operative position in advance of the handle. A locking device locks the blade in an operative position and comprises a disc rotatably mounted on the one end of the handle with a slot to engage the blade. The slot has a radial portion and a circumferential position so that the blade first enters the radial portion and the disc is then rotated to hold the blade in the circumferential portion.

U.S. Pat. No. 4,300,607 (Mellinger, 1981) discloses a segmented handle characterized by an upper gripping member having an opening which partially extends therethrough. At least one lower gripping member is positioned adjacent the upper gripping member and has an opening extending therethrough to permit communication with the opening in the upper gripping member. An apparatus for releasably securing the gripping members in a fixed, coaxial relationship is positioned on adjacent portions of said members. Alternatively, the above apparatus may be disposed in the opening of the upper gripping member.

Most prior screwdrivers having bit storage means in the handle utilize a longitudinal bore in which the bits are placed in an orientation such that the long axis of the bit is substantially parallel to the long axis of the screwdriver. For example, U.S. Pat. No. 4,278,119 (Elmore, 1981) provides a hand tool of the type including a shaft having on one of its two opposite ends a handle and on the other of its two opposite ends socket means for selectively receiving and holding a removable tool tip with means to be used in combination with it for storing a plurality of removable tool tips. Basically, the tool tip storage means comprises a generally cylindrical storage member having a bore along its long central axis that is mounted on the tool shaft for slideable movement between the tool handle and socket means. The storage member also has a first surface that faces the socket means and is engaged by yieldable means that encircles the tool shaft and extends between and is compressed between the first surface and the socket means. The storage member further has a second surface opposite from its first surface that is provided with openings into a plurality of chambers which are radially and angularly spaced apart around its central bore and are aligned generally parallel to the long central axis of the tool shaft. The chambers each have a width and depth sufficient to slideably receive and store any tool tip intended to be removably received and held by the socket means. The chambers each extend toward the first surface of the storage member from one of the openings in the second surface thereof, with that second surface being yieldably urged away from the socket means and into engagement with a generally complementary surface of the tool handle by the yieldable means.

Similarly, U.S. Pat. No. 4,227,430 (Jansson et al, 1980) discloses a rotatable hand tool, especially a screwdriver or other rotating tool for screws or nuts. The tool is of the kind having cavities in its handle for storing at least one, or usually several tool bits, which can optionally be attached to a holder attached to and turned by the holder. Such bits can, for example, constitute screwdriver tips, hexagonal socket keys and hexagonal sockets. The handle consists of two main parts, of which one is rotatably enclosed in the other and has cavities arranged in the form of recesses in its periphery, these recesses being accessible by turning the enclosed part so that one of its recesses coincides with an opening in the other part. A limited axial movement between both handle parts and between coacting locking means thereon enables these parts to turn respective to each other in an outer axial position, and is locking them against rotation in an inner axial position in the enclosed part.

U.S. Pat. No. 3,667,518 (Stillwagon, Jr., 1972) discloses a hand tool in the form of a screwdriver in which a series of tool bits are stored in longitudinal recesses formed in the outer circumferential surface of the handle. The tool bits are retained in the recesses by an elastic O-ring, and may be easily removed by rolling back the O-ring for snap fitting into the shank portion of the tool.

Exemplary of still other screwdriver tools having bit storage means in their handles are the tools disclosed in U.S. Pat. Nos. 2,577,651 (Dewey, 1951); 2,022,775 (Holland-Letz, 1935); 1,555,109 (Eliason, 1925); and 10,500 (Chamberlain, 1854).

Despite the large number of hand tools having storage means in the handles thereof which are known in the prior art, none teach or suggest the novel tool of this invention described more fully hereinbelow.

SUMMARY OF THE INVENTION

A screwdriver is provided having a shaft and a handle and magnetic holding means mounted at the work end of the shaft for removably holding metal screwdriver bits, and storage means in the handle for storing a plurality of bits. The storage means comprise a plurality of bores in the handle tranversely oriented with respect to the longitudinal axis of the screwdriver, in which bores resiliant sleeves are affixed which, when affixed in the handle bores, have internal diameters slightly smaller than the bits to be stored therein. When one of the stored bits is desired for use, the user removes the bit previously used from the magnetic holding means and presses the bit into the opening of the sleeve holding the desired bit, thereby freeing the desired bit and, at the same time, storing the bit previously used, following which the desired bit is affixed to the magnetic holding means.

Preferably the length of the sleeves is shorter than the length of the bores, the bores each having a circular shelf at one end thereof, that end being the eject end of the bores, the internal diameter of the shelf being substantially that of the stored bits, the sleeves being press-fit into the bores to rest upon the shelf and be retained thereby upon ejection of one of the bits.

The resiliant sleeves are preferably fabricated from Tygon® tubing.

Figures 1, 2, 3, 4, 5:
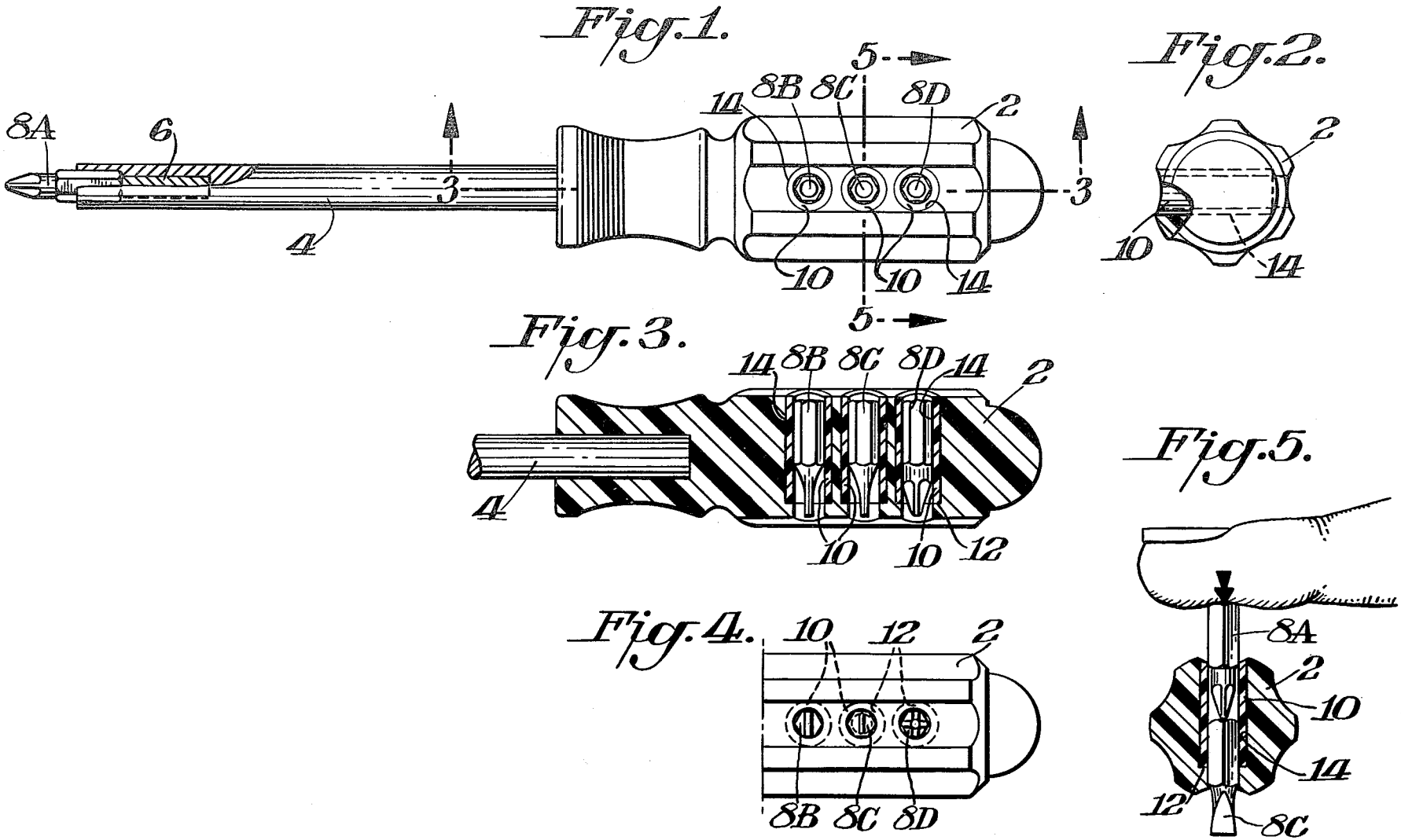
FIG. 1 is a top plan view partially broken away of the screwdriver of this invention.
FIG. 2 is an end elevation, in part broken away, of the tool.
FIG. 3 is a cross-sectional view of the bit storage handle of the tool of this invention taken along line 3—3 of FIG. 1.
FIG. 4 is a bottom plan view of the tool of this invention.
FIG. 5 is a cross-sectional view of the tool of this invention taken along line 5—5 of FIG. 1 showing a user removing one bit from storage for use and simultaneously storing a bit temporarily not needed.

DETAILED DESCRIPTION OF THE INVENTION AND PREFERRED EMBODIMENTS WITH REFERENCE TO THE DRAWINGS

A screwdriver is provided having a handle for storing bits. The stored bits are held in the handle in transverse orientation with respect to the long axis of the screwdriver by sleeves of resiliant material which are press fit into transverse openings through the handle. The sleeves have internal diameters slightly smaller than the outside diameters of the bits being stored. To remove one of the stored bits for use, the user simply removes the bit previously used and which is magnetically held to the screwdriver shaft and presses it into the opening in the sleeve holding the desired bit, thereby freeing the desired bit and, at the same time, storing the bit previously used. The desired bit is then affixed to the magnetic holding means.

The screwdriver of this invention enables the skilled artisan such as a cabinet maker or other persons who use screwdrivers to rapidly change the bit in a magnetic screwdriver and simultaneously store the removed bit to minimize loss, and thereby can save much time now wasted. Details of the invention are best explained by reference to the drawings.

FIG. 1 shows a top plan view of the screwdriver of this invention having body or handle 2 which holds shaft 4 having magnetic means 6, shown in part broken away, for holding metal screwdriver bits such as the "Phillips" bit 8A shown. In the handle 2 are bores 14 in which resiliant sleeves 10 are affixed. The resiliant sleeves 10 have inside diameters which are slightly smaller than the outside diameters of the bits 8B, 8C and 8D which are inserted into the sleeves 10 as shown and are held snugly therein. The stored bits in normal use will not fall out of these sleeves, even upon dropping the screwdriver.

FIG. 2 shows the handle 2 in end elevation, in part broken away to show the resiliant sleeve 10 affixed in bore 14 of the handle.

FIG. 3 shows, in a cross-section taken along line 3—3 of FIG. 1, the screwdriver shaft 4 affixed in handle 2, the handle having bores 14 in which are affixed the resiliant sleeves 10 holding bits 8B, 8C and 8D. As indicated in FIG. 3, bores 14 can be countersunk and formed with circular shelf 12 at the bit eject end of the bore. When resiliant sleeves 10 are affixed in the bores 14, for example by press fitting as is preferred, the circular shelves 12 prevent these sleeves from moving or falling out upon ejection of a bit being stored. The inside diameter of these circular shelves is substantially the same as, or slightly larger than, the bits being stored, which must pass through the openings inside the shelves upon ejection.

FIG. 4 shows a bottom view of handle 2 illustrating sleeves 10 and shelves 12 in phantom, and bits 8B, 8C and 8D stored therein.

FIG. 5 illustrates a use of the screwdriver of this invention. When bit 8A is no longer needed by the artisan, and a new bit, say 8C is desired, the user removes bit 8A from the magnetic shaft and presses it into the storage compartment holding bit 8C as shown. When bit 8A is pressed into this storage compartment as indicated by the arrow, bit 8C will be ejected and 8A will be stored, simultaneously. In FIG. 5, the handle 2 is shown with resiliant sleeve 10 and circular shelf 12 for completeness.

In a preferred embodiment, a resiliant sleeve fabricated from Tygon® tubing is used. In a screwdriver having a handle with diameter 1-3/16 inch, sleeves of Tygon® tubing having length of 15/16, outside diameter of 7/16 and inside diameter 5/16 inch can be press fit into bores having lengths of 15/16 and inside diameters of 13/32 inch, and at the eject end of each bore, having a circular shelf with shelf height 3/16 inch and inside diameter of 9/32 inch. Upon insertion of the Tygon® tubing, the inside diameter of the tube is compressed somewhat and bits such as #1 and #2 common and #1 and #2 "Phillips" can be stored snugly and conveniently therein. These bits have outside diameter of 9/32 inch.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A screwdriver having a shaft and a handle and magnetic holding means mounted at the work end of said shaft for removably holding metal screwdriver bits, and storage means in said handle for storing a plurality of bits, said storage means comprising:

a plurality of through-going bores in said handle transversely oriented with respect to the longitudinal axis of said screwdriver, in which bores resilient sleeves are affixed which, when affixed in said handle bores, have internal diameters slightly smaller than the bits stored therein, said bits being stored within said sleeves such that the longitudinal axes of the bits are also transversely oriented with respect to the longitudinal axis of the screwdriver, i.e. the long axes of the stored bits correspond to the long axes of the through-going bores and sleeves, the handle of said screwdriver having a width substantially equal to the length of said bits, whereby, when one of the stored bits is desired for use, the user removes the bit previously used from said magnetic holding means and presses said bit into the opening of the sleeve holding the desired bit, thereby freeing the desired bit and, at the same time, storing the bit previously used, following which the desired bit is affixed to said magnetic means.

2. The screwdriver of claim 1 wherein said sleeves have outside diameters slightly larger than the inside diameter of said bores and are press-fit into said bores.

3. The screwdriver of claim 1 wherein said sleeves are affixed to said bores by means of an adhesive.

4. The screwdriver of claim 1 wherein the length of said sleeves is shorter than the length of said bores, said bores each having a circular shelf at one end thereof, said end being the eject end of said bores, the internal diameter of said shelf being substantially that of said stored bits, said sleeves being press-fit into said bores to rest upon said shelf and be retained thereby upon ejection of one of the said bits.

5. The screwdriver of claim 1 wherein said resiliant sleeves are fabricated from resilient plastic tubing.

* * * * *